United States Patent [19]

Wrigley

[11] Patent Number: 4,717,123

[45] Date of Patent: Jan. 5, 1988

[54] SECURING AGENT

[75] Inventor: Andrew N. Wrigley, Auckland, New Zealand

[73] Assignee: ITW New Zealand Limited, Auckland, New Zealand

[21] Appl. No.: 15,901

[22] Filed: Feb. 18, 1987

[30] Foreign Application Priority Data

Feb. 21, 1986 [NZ] New Zealand ..... 215246

[51] Int. Cl.[4] ..... B21F 27/00; E04H 17/02

[52] U.S. Cl. ..... 256/48; 256/10; 174/158 F

[58] Field of Search ..... 174/158 F, 163 F, 155, 174/156; 256/10, 48

[56] References Cited

U.S. PATENT DOCUMENTS

D. 108,489 2/1938 Dalton ..... 174/158 F

FOREIGN PATENT DOCUMENTS 550035 12/1922 France ..... 174/155

1443330 7/1976 United Kingdom ..... 174/163 F

*Primary Examiner*—Andrew V. Kundrat

*Attorney, Agent, or Firm*—J. P. O'Brien; T. W. Buckman

[57] ABSTRACT

A clip assembly is formed by joining two identical clip members, each having a body portion with a bore therethrough, a pair of protrusions integrally formed on one end of the body in alignment with the bore, a hook portion on the body and a plurality of teeth lengthwise on each protrusion for ratchet engagement with the teeth on the opposed pair of protrusions as the numbers are fitted together.

4 Claims, 5 Drawing Figures

SECURING AGENT

Figure 1:
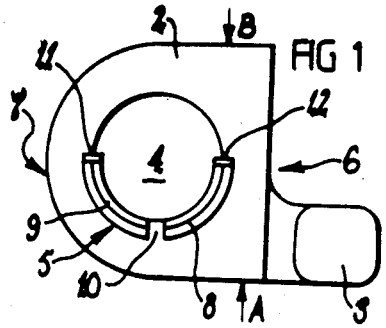

This invention relates to a securing arrangement usable for locating and securing elongate strips, such as for example wire, cord and the like, and more particularly to a securing arrangement which comprises one clip member, engageable with a further suitable or appropriate member.

Up until the present time there have been numerous means available which are suitable for use in locating and securing elongate strips, such as fencing wire, to upright fencing members, such as posts, stakes and the like. These means have included various types of clips, staples, fasteners and the like. Many of these means have not been suitable for use in some circumstances, such as for example in locating and securing electric fence wire or strip relative to electric fence posts, stakes and the like. Many of these means have disadvantages associated with them, in that some have been difficult or expensive to manufacture, some are of a relatively complex form, which are difficult to assemble and use, and still others have proved unsatisfactory in that they require constant maintenance, or an unacceptably high amount of maintenance. Thus, previously known means have generally proved inadequate for the purpose, or have had disadvantages associated with them which make them relatively difficult or expensive to use.

It is an object therefore of one aspect of the present invention to provide a securing arrangement which goes some way towards overcoming or at least minimising the abovementioned problems.

It is a further object of one aspect of the present invention to provide a clip member adapted for use with a further suitable member, to form a securing arrangement which goes at least some way towards overcoming the abovementioned problems.

Further objects of the present invention will become apparent from the following description.

According to one aspect of the present invention there is provided a clip member comprising a body portion, securing means and engaging means, wherein said securing means extends outwardly from one side of said body portion, and said engaging means includes at least one bore extending through said body portion, and at least one protrusion extending outwardly from one face of said body portion, about or adjacent said bore.

According to a further aspect of the present invention there is provided a clip member comprising a body portion, securing means and engaging means; wherein said securing means comprises a substantially hooked protrusion extending outwardly from one face of said body portion, and said engaging means includes a bore extending through said body portion and at least one substantially curved protrusion, extending outwardly from one face of said body portion substantially about or around at least part of the periphery of said bore, and extending at least partially into said bore.

According to a still further aspect of the present invention there is provided a securing arrangement, including at least one clip member and at least one further member, wherein said clip member comprises a body portion, securing means and engaging means, said securing means extending outwardly from one side of said body portion, and said engaging means including at least one bore extending through said body portion and at least one protrusion extending outwardly from one face of said body portion, about or adjacent said bore; the arrangement being such that in use said clip member and said further member are releaseably engaged one with the other, so as to be capable of locating and securing an elongate strip in a predetermined position, relative to said arrangement.

According to a still further aspect of the present invention there is provided a securing arrangement, including at least two clip members; wherein each of said clip members comprises a body portion, securing means and engaging means, said securing means extending outwardly from one side of said body portion, and said engaging means including at least one bore extending through said bore portion and at least one protrusion extending outwardly from one face of said body portion, about or adjacent said elongate bore; the arrangement being such that in use said at least two clip members are releaseably engaged, one with the other, thereby contacting or engaging a member located within said bores of respective clip members, such that said securing means of said respective clips are located substantially adjacent one another so as to be capable of locating and securing an elongate strip in a predetermined position relative to said arrangement and said member.

Further aspects of the present invention will become apparent from the following description.

In one preferred embodiment of the present invention there is provided a clip member, the arrangement being such that in use at least two of said clip members releaseably engageable one with the other, so as to form a securing arrangement. The securing arrangement and clip member will now be described by way of example only, and with reference to the accompanying drawings, in which:

FIG. 1: shows a plan view of a clip member according to one aspect of the present invention.

Figure 2:
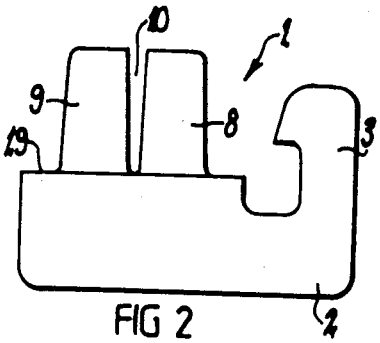

FIG. 2: shows a side view of the clip member shown in FIG. 1, when viewed from side A.

Figure 3:
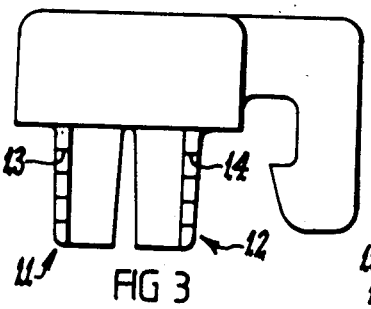

FIG. 3: shows a side view of the clip member shown in FIG. 1, when viewed from side B.

Figure 4:
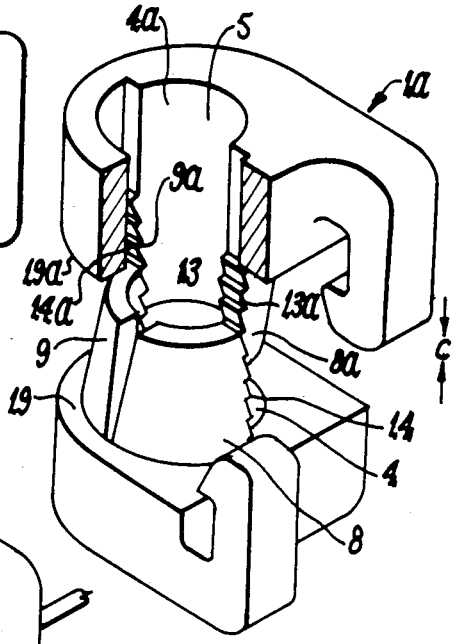

FIG. 4: shows a perspective view of two of the clip members shown in FIGS. 1 to 3, in the partially engaged position.

Figure 5:
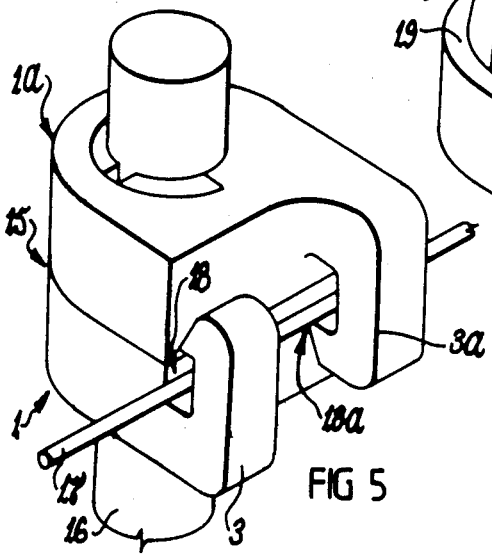

FIG. 5: shows a perspective view of a securing arrangement according to one aspect of the present invention.

Referring firstly to FIGS. 1 and 2, there is provided in one preferred form of the invention a clip member 1. The clip member 1 includes a body portion 2. The body portion 2 includes a substantially straight surface 6, which has securing means in the form of a hooked portion 3 extending outwardly therefrom. The body portion 2 is also provided with a substantially curved or arcuate surface 7, located in a position which is substantially opposite that of the surface 6. The remaining surfaces of the body portion 2 are substantially flat.

The clip member 1 is also provided with engaging means. In the preferred form of the invention shown in the accompanying drawings, the engaging means includes a substantially circular bore 4 extending through the body portion 2, and a protrusion 5 extending through the bore, which is located at the periphery and on one side thereof, and which extends outwardly from and beyond the bore 4.

The protrusion 5, which extends through the bore 4, is an integral part of the body portion 2, in that the protrusion 5 comprises a continuation of the body portion 2 extending into the bore 4, at or from the periphery of the bore 4. The protrusion 5 extends at least partially around the periphery of the bore 4. In the preferred form of the invention shown in the accompanying drawings, the protrusion 5 extends around one half of the periphery of the bore 4. Thus, the radius of the bore 4 at or adjacent the protrusion 5 is reduced relative to the radius of the bore 4 at or adjacent that part which is not provided with the protrusion 5. This can be seen from FIG. 1.

The protrusion 5 extends outwardly from and beyond the body portion 2, as shown best in FIG. 4. The portion of the protrusion 5 which extends outwardly from and beyond the bore 4 is formed into two extending portions 8 and 9. A space 10 is provided therebetween.

The extending portions 8 and 9 are substantially curved, so as to form a continuation of the portion of the protrusion 5 which is located within the bore 4. Thus, as shown in FIG. 1, the protrusions 8 and 9 extend around a part of the periphery of the bore 4.

As shown in FIG. 2, the extending portions 8 and 9 are tapered towards the distal end thereof.

The extending portions 8 and 9 are formed such that they extend slightly towards the centre of the bore 4, towards the distal end thereof. Thus, the extending portions 8 and 9 are angled slightly inwardly towards the centre of the bore 4, at or towards the outer or distal ends thereof.

As will be seen from FIG. 1, the extending portions 8 and 9 not only extend outwardly from the periphery of the bore 4, but at least a portion of the extending portions 8 and 9 also extend upwardly and outwardly from the surface 19 of the body portion 2, in a position substantially adjacent the periphery of the bore 4.

In the preferred form of the invention shown in the accompanying drawings, the protrusion 5 and the hooked portion 3 are located on the same side A of the clip member 1. It is envisaged, however, that the hooked portion 3 and the protrusion 5 may be located on opposite sides of the slip member 1. That is, either one of the hooked portion 3 or the protrusion 5 may be located on side B of the clip member 1.

As shown in FIG. 3, outer edges 11 and 12 of the extending portions 8 and 9 are provided with a plurality of barbs or teeth 13 and 14 forming a ratchet. The purpose of these teeth 13 and 14 will become apparent from further description given hereinafter.

As shown in FIGS. 2 and 3, the hooked portion 3 extends outwardly from and beyond the body portion 2 of the clip member 1, and is so formed as to extend in a direction which is similar to that in which the extending portions 8 and 9 extend.

It is envisaged, however, that the hooked portion may extend in another direction, without departing from the scope of the invention.

In a further preferred form of the invention there is provided a securing arrangement, comprising a clip member as hereinabove described, adapted to engage with a further suitable or appropriate member.

For example, in one preferred form of the invention as shown in FIGS. 4 and 5, a clip member 1 is releaseably engageable with a substantially similar clip member 1*a*, thereby forming a securing arrangement 15. The arrangement 15 will now be described with reference to the accompanying drawings.

In order to releaseably engage two substantially similar clip members 1 and 1*a*, one of the members is inverted relative to the other and the members are positioned such that the extending portions 8 and 9 of the clip portion 1 are adjacent to but inverted relative to the corresponding engaging members 8*a* and 9*a* of the clip member 1*a*.

The clip members 1 and 1*a* are then moved towards each other in the direction generally indicated by the arrow C shown in FIG. 4. Upon application of a suitable force or pressure in the direction indicated by the arrow C, the teeth 13 and 14 of the clip member 1 engage with and are forced passed the teeth 13*a* and 14*a* of the clip member 1*a*. Thus, the extending portions 8 and 9 ratchet together with the extending portions 8*a* and 9*a*. In this manner, the extending portions 8 and 9 of the clip member 1 are moved to a position substantially within the bore 4*a* of the clip member 1*a*. At the same time, the extending portions 8*a* and 9*a* of the clip member 1*a* are moved to a position substantially within the bore 4 of the clip member 1.

Suitable force or pressure may be applied in the manner described above, by use of a suitable means, such as for example, pliers, suitable tools, hands and the like. Such force is preferably applied in a direction such as that generally indicated by the arrows C as shown in FIG. 4. This pressure forces the respective extending portions 8 and 9, and 8*a* and 9*a* into the respective bores 4 and 4*a*.

As will be seen in FIG. 5 of the accompanying drawings, in use the securing arrangement 15 is located about or around a suitable fencing member such as a shaft or post 16. Thus, the shaft or post 16 extends through the respective bores 4 and 4*a* of the arrangement 15. The shaft or post 16 is engaged with the securing arrangement 15 upon engagement of the clip members 1 and 1*a* in the following manner.

Clip members 1 and 1*a* are located about the post or stake 16, by location of the post or stake 16 through the bores 4 and 4*a*, with one of the clips being inverted relative to the other. A suitable force or pressure is then applied to the clip members 1 and 1*a*, in the manner described above, in order that the teeth 13 and 14 engage with the teeth 13*a* and 14*a*. Thus, the respective extending portions 8 and 9, and 8*a* and 9*a* are located within the respective bores 4*a* and 4.

In order for this location to be achieved, the extending portions 8, 9, 8*a* and 9*a* are forced away from their normal positions, in a direction towards the centre of the bores 4 and 4*a*. The result of this is the extending portions 8, 9, 8*a* and 9*a* come into contact with the outer surface of the shaft or post 16, and thus are secured thereto.

The action of forcing the extending portions 8, 9, 8*a* and 9*a* towards the centres of bores 4 and 4*a* can be explained in the following way. As described above, the extending portions 8 and 9 of the clip member 1 extend not only outwardly from the periphery of the bore 4, but also at least a portion of the extending portions 8 and 9 extend from the surface 19 of the body portion 2, in a position substantially adjacent the periphery of the bore 4. Thus, when the clip member 1*a* moves into the engaged position with the clip member 1 the surface 19*a* will come into contact with the surface 19. Because at least part of the extending portions 8 and 9 extend beyond the periphery of the bore 4 on to the surface 19, the extending portions 8 and 9 are forced inwardly. Similarly, with the extending portions 8*a* and 9*a* of the clip 1*a*.

It will be appreciated from the above that the space 10 provided between the extending portions 8 and 9 facilitates assembly of the arrangement 15, in that the extending portions 8 and 9 are able to move at least partially into the space 10, and thus may be more easily located within the bore 4*a* of the clip member 1*a*. Similarly with the space provided between the extending portions 8*a* and 9*a*.

When the securing arrangement 15 is fully engaged, the surfaces 19 and 19*a* abut one another, as shown in FIG. 5. Furthermore, the clip members 1 and 1*a* are positioned such that the hooked portions 3 and 3*a* are situated adjacent one another, but spaced apart therefrom, and inverted relative to one another. This allows an elongate strip 17 to be located or secured in a predetermined or desired position relative to the arrangement 15 and the stake or post 16.

As shown in FIG. 5, the hooked portion 3 of the clip member 1, for example, is positioned so as to have the opening 18 thereof facing in a substantially upward direction, while the hooked portion 3*a* of the clip member 1*a* is positioned so as to have the corresponding opening 18*a* positioned so as to face in a substantially downward position.

The substantially elongate strip 17 is thus positioned by insertion through the openings 18 and 18*a*. Removal of the elongate strip 17 is facilitated by movement of the same through the openings 18 and 18*a*. It will be apparent that this removal may be easily facilitated by an operator, by moving the elongate strip 17 first through one opening and then through the other. At the same time, however, it will be appreciated that accidental movement of the elongate strip 17 through both of the openings 18 and 18*a* is unlikely to occur. Thus, while the strip 17 is relatively easy to remove from its position relative to the securing arrangement 15, it is unlikely that this will happen accidentally, or without an operator assisting in the movement.

The elongate strip 17 may be any strip which is required to be secured. For example, fence wire and in particular electric fence wire may be secured. However, it is envisaged that any suitable strip may be secured.

Although the invention has been described by way of example, and with particular reference to various embodiments thereof, it is envisaged that modifications may be made thereto without departing from the scope thereof. For example, it is envisaged that the securing arrangement according to this invention may comprise at least two substantially similar clip members, as described above. However, it is also envisaged that at least one clip member as described above may be engaged with a further suitable or appropriate member.

As described, the securing arrangement of the present invention comprises at least two securing devices. However, it is envisaged that the securing arrangement may be formed as an integral unit, that unit including engaging means capable of engaging a suitable upright member in the manner described above. For example, the securing arrangement may comprise two of the clip members described above, the clip members being joined or attached in some way so as to form an integral unit.

The clip member according to the present invention has also been described as an integral unit. However, it is envisaged that the clip member may be formed of a number of inter-engaging parts.

It should also be appreciated that the securing means provided in the form of a hooked portion may take other forms. For example, there may be provided clips, slots and the like.

It should also be appreciated that in other forms of the invention the body portion may, for example, comprise substantially flat or straight sides, rather than at least one curved or arcuate side.

It should also be appreciated that the hooked portion or other securing means may extend from a different side to that shown in the accompanying drawings and described. For example, the securing means may extend from a side of the clip member which is opposite to that from which the extending portions which form part of the engaging means extend.

It is envisaged that the clip member according to the present invention may be formed by any suitable technique and from any suitable material. A resilient plastic material is preferable, in that this allows for relatively easy engagement of the clip members one with the other. However, it is also envisaged that other materials may be used to advantage. Polyproplyene is particularly suitable.

Any suitable technique may be used, and in particular moulding or extruding from plastic is desirable.

In a particularly preferred form of the invention, it is envisaged that the securing arrangement provided by the invention is used to secure electric fence wire to suitable upright members, such as fibreglass rods. However, it should be appreciated that the securing arrangement may be used to secure other objects or articles to suitable members.

By this invention there is provided a clip member, the arrangement being such that at least one clip member is engageable with a further suitable member, so as to form a securing arrangement suitable for use in fencing and the like.

The present invention has been described by way of example only, and it should be appreciated that modifications and improvement may be made without departing from the scope or spirit thereof, as defined in the appended claims.

What we claim:

1. A clip assembly is adapted to be formed by joining together two identical clip members, each of said clip members comprising a body portion having a bore formed therethrough, a pair of protrusions integrally formed on one end of said body portion and extending away from said one end in direct alignment with said bore, and a book portion integrally formed with said body portion, a plurality of teeth formed lengthwise on each of said protrusions, whereby upon said two identical clip members being brought together by positioning said pair of protrusions of said two identical clip members in opposed mating relation such that said plurality of teeth of said pair of protrusions ratchet together with said plurality of teeth of said opposed pair of protrusions as said two identical clip members are squeezed together.

2. A clip assembly as defined in claim 1, wherein said body portion has a flat surface parallel to the axis of said bore and wherein said hook portion has a first arm portion extending perpendicular from said flat surface and a second arm portion and extending parallel to said flat surface.

3. A clip assembly is adapted to be formed by joining together two identical clip members, each of said clip members comprising a body portion having a bore formed therethrough, a pair of spaced apart curved protrusions integrally formed in a semi-circular arrangement on one end of said body portion and extending away from said one end in direct alignment with said bore, and a hook portion integrally formed with said body portion, a plurality of teeth formed along the outermost edge of each of said curved protrusions, whereby upon said two identical clip members being brought together by positioning said pair of protrusions of said two identical clip member in opposed mating relation such that said plurality of teeth of said pair of protrusions ratchet together with said plurality of teeth of said opposed pair of curved protrusions as said two identical clip member are squeezed together.

4. A clip assembly as defined in claim 3, wherein said body portion has a flat surface parallel to the axis of said bore and wherein said hook portion has a first arm portion extending perpendicular from said flat surface and a second arm portion integrally formed with said first arm portion and extending parallel to said flat surface.

* * * * *